US007802793B2

(12) United States Patent
Mahar et al.

(10) Patent No.: US 7,802,793 B2
(45) Date of Patent: Sep. 28, 2010

(54) GAME OF CHANCE

(75) Inventors: Nicola Jane Mahar, Brisbane (AU); Rachel King, New Farm (AU); Lisa Waugh, Mt Gravatt East (AU); Ben Allen, Willer's Hill (AU)

(73) Assignee: Golden Casket Lottery Corporation Limited, Queensland (AU)

( * ) Notice: Subject to any disclaimer, the term of this patent is extended or adjusted under 35 U.S.C. 154(b) by 516 days.

(21) Appl. No.: 11/576,374

(22) PCT Filed: Sep. 30, 2005

(86) PCT No.: PCT/AU2005/001502

§ 371 (c)(1),
(2), (4) Date: Mar. 30, 2007

(87) PCT Pub. No.: WO2006/034555

PCT Pub. Date: Apr. 6, 2006

(65) Prior Publication Data

US 2008/0252003 A1 Oct. 16, 2008

(30) Foreign Application Priority Data

Sep. 30, 2004 (AU) ..... 2004905640

(51) Int. Cl.
*A63F 3/06* (2006.01)

(52) U.S. Cl. ..... 273/139; 273/248; 273/249; 273/269; 283/901; 283/903

(58) Field of Classification Search ..... 273/139, 273/138.1, 269, 240, 248, 249; 283/901, 283/903

See application file for complete search history.

(56) References Cited

U.S. PATENT DOCUMENTS

| | | | | |
|---|---|---|---|---|
| 4,191,376 | A * | 3/1980 | Goldman et al. | 273/139 |
| 5,657,991 | A * | 8/1997 | Camarato | 273/269 |
| 2001/0049305 | A1 | 12/2001 | Riendeau et al. | |
| 2002/0019260 | A1 | 2/2002 | Angell, Jr. | |
| 2002/0084584 | A1 | 7/2002 | Yusuf | |
| 2003/0025270 | A1 | 2/2003 | Schaefer et al. | |

* cited by examiner

*Primary Examiner*—Benjamin H Layno
(74) *Attorney, Agent, or Firm*—Fredrikson & Byron

(57) ABSTRACT

A game of chance playable by two or more players and a method of playing the game, the game of chance comprising a gaming ticket (2) including removable first portions (8) removable by a first player to reveal first indicia and removable second portions (10) removable by a second player to reveal second indicia, wherein the first and second players compete against each other by removing the respective removable first indicia until a winner of the game is determined.

27 Claims, 8 Drawing Sheets

GAME OF CHANCE

FIELD OF THE INVENTION

The invention relates to games of chance. In particular, the invention relates to games of chance in the form of gaming tickets comprising removable portions that provide enhanced playability compared with conventional gaming tickets.

BACKGROUND TO THE INVENTION

Games of chance can be found in many forms. Gaming tickets such as the instant lottery type of gaming tickets are one such form that has maintained its popularity over time. Such tickets are usually made of card and typically comprise removable portions such as tear off flaps or scratch off layers. The removable portions obscure at least part of a playing region comprising indicia and/or some form of game. A player removes one or more removable portions to reveal the indicia and discover whether they have won a prize. For example, three indicia of the same type may need to be revealed to win a monetary prize. The tickets can be purchased for a relatively small sum and provide the opportunity of instantly winning a substantially larger award. Such tickets additionally provide entertainment for the player and revenue for the operator.

However, often the entertainment provided by conventional tickets is short-lived in that the removable portions can quickly be removed and in the absence of winning a prize the player can feel dissatisfied. Hence, operators and players alike are always searching for new types of gaming tickets that provide enhanced playability.

In this specification, the terms "comprises", "comprising" or similar terms are intended to mean a non-exclusive inclusion, such that a method, system or apparatus that comprises a list of elements does not include those elements solely, but may well include other elements not listed.

SUMMARY OF THE INVENTION

In one form, although it need not be the only or indeed the broadest form, the invention resides in a game of chance playable by two or more players, said game of chance comprising:

a gaming ticket including removable first portions removable by a first player to reveal first indicia and removable second portions removable by a second player to reveal second indicia;

wherein said first and second players compete against each other by removing said respective removable first and second portions to reveal further first and second indicia until a winner of said game is determined.

Preferably, the gaming ticket further comprises a removable third portion removable by the winner of the game of chance to reveal whether the winner wins a prize.

Preferably, removal of the first and second portions reveals indicia in the form of instructions for the players to follow in playing the game.

Suitably, the instructions are in the form of a predetermined outcome of a nominally random event.

Suitably, the predetermined outcome of the nominally random event determines the number of first or second portions removed by the first or second player respectively.

Suitably, the predetermined outcome of the nominally random event determines the next first or second portion removed by the first or second player respectively.

The game of chance may further comprise a removable fourth portion wherein removal of the fourth portion reveals indicia in the form of a predetermined outcome of a nominally random event.

Suitably, the predetermined outcome of the nominally random event determines which player takes a first turn.

Suitably, the nominally random event is one of the following: a coin toss, a throw of a die or dice.

The game of chance may further comprise a removable fifth portion wherein removal of the fifth portion reveals indicia in the form of instructions which determine the next removable first or second portion removed by the first or second player respectively.

Suitably, the game of chance comprises at least two adjoined gaming tickets.

Suitably, a first gaming ticket of the at least two adjoined gaming tickets comprises the removable first portions and a second gaming ticket of the at least two adjoined gaming tickets comprises the removable second portions.

Suitably, the at least two adjoined gaming tickets are identical.

In another form, the invention resides in a method of playing a game of chance playable by two or more players, the method including the steps of:

a) a first player removing a removable first portion of a gaming ticket to reveal first indicia;

b) a second player removing a removable second portion of said gaming ticket to reveal second indicia;

c) said first and second players competing against each other by said first player repeating step a) and said second player repeating step b) to reveal further first and second indicia until a winner of said game of chance is determined.

The method may further include the step of the winner of the game of chance removing a removable third portion of the gaming ticket to reveal whether the winner wins a prize.

Suitably, steps a) and b) further include the first and second players following instructions for playing the game revealed by the removal of said first and second portions.

Suitably, the instructions are in the form of a predetermined outcome of a nominally random event.

The method may further include the step of the predetermined outcome of the nominally random event determining the number of first or second portions removed by the first or second player respectively.

The method may further include the step of the predetermined outcome of the nominally random event determining the next first or second portion removed by the first or second player respectively.

The method may further include the step of one of the players removing a removable fourth portion to reveal a predetermined outcome of a nominally random event.

The method may further include the step of the predetermined outcome of the nominally random event determining which player takes a first turn.

Suitably, the nominally random event is one of the following: a coin toss, a throw of a die or dice.

The method may further include the step of one of the players removing a removable fifth portion to reveal indicia in the form of instructions for determining the next removable first or second portion removed by the first or second player respectively.

In a further form, the invention resides in a game of chance playable by two or more players, said game of chance comprising a gaming ticket including a first set of indicia revealable by a first player and a second set of indicia revealable by a second player, wherein said first and second players compete against each other by sequentially revealing said respective first and second indicia in accordance with associated instructions until a winner of said game is determined.

Further features of the present invention will become apparent from the following detailed description.

BRIEF DESCRIPTION OF THE DRAWINGS

To assist in understanding the invention and to enable a person skilled in the art to put the invention into practical effect preferred embodiments of the invention will be described by way of example only with reference to the accompanying drawings, wherein.

DETAILED DESCRIPTION OF THE INVENTION

Figure 1A:
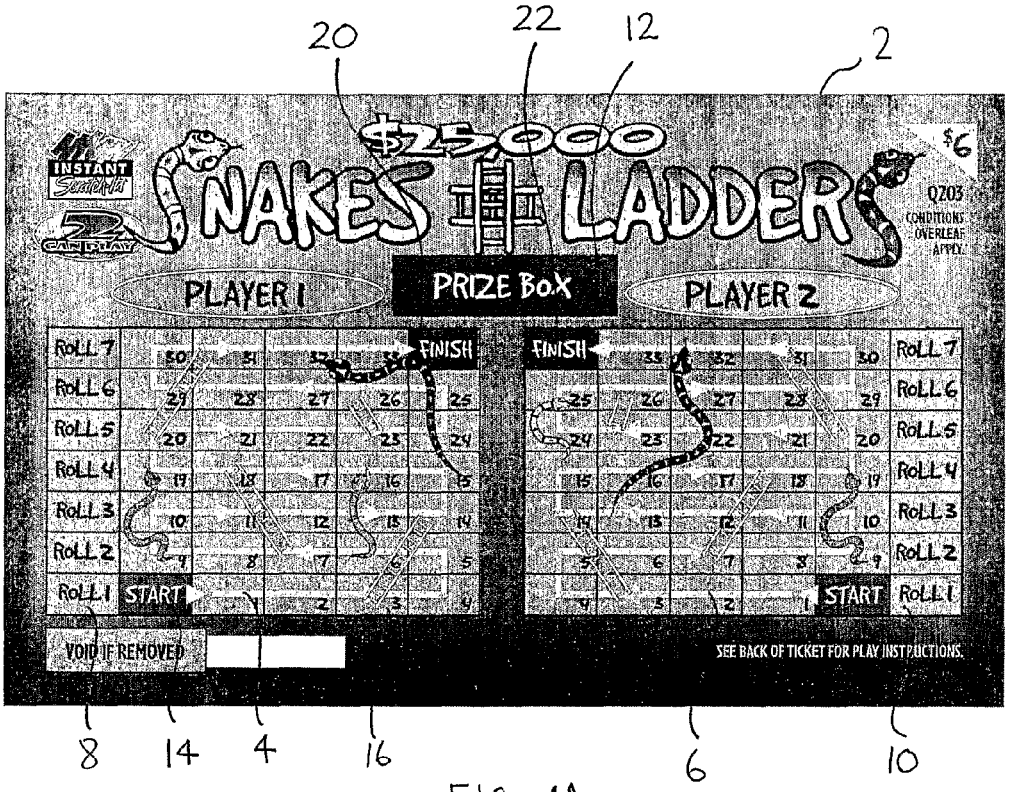
FIG. 1A shows a first embodiment of the gaming ticket before use.

In the drawings, like numerals on different FIGS are used to indicate like elements throughout.

FIG. 1A shows a first embodiment of the gaming ticket 2 of the game of chance according to the present invention. Gaming ticket 2 comprises a playing region 4 for a first player (player 1) and a playing region 6 for a second player (player 2). Playing regions 4 and 6 represents a "snakes and ladders" type board and a number of squares representing rolls of a die. Playing region 4 comprises removable first portions 8 removable by the first player and playing region 6 comprises removable second portions 10 removable by the second player. Gaming ticket 2 also comprises a removable third portion 12 removable by a winner of the "snakes and ladders" type game to reveal whether the winner wins a prize.

The removable portions may be in the form of scratch off layers that may be removed by, for example, the edge of a coin. Alternatively, the removable portions may be in the form of tear-off flaps or the like. Both forms are familiar to persons skilled in the relevant art and any other suitable form of removable portion known in the art may alternatively be employed.

Figure 1B:
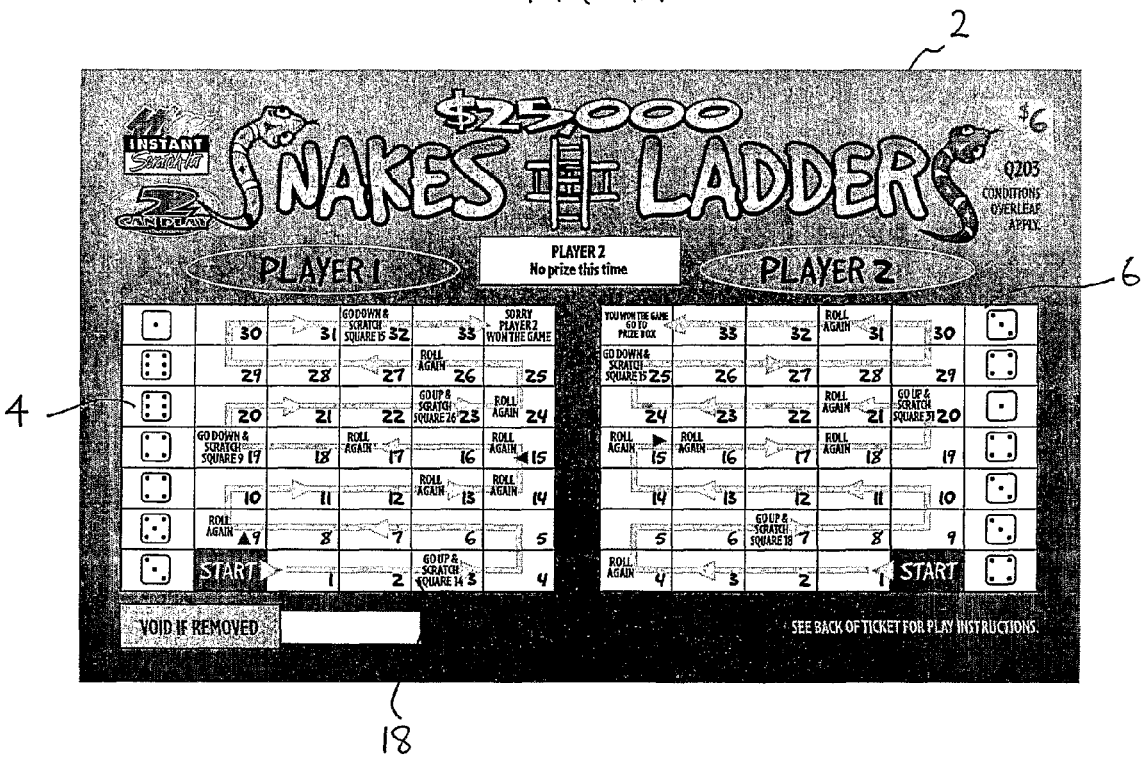
FIG. 1B shows the gaming ticket of FIG. 1A after use.

With additional reference to FIG. 1B, in this embodiment, player 1 starts the game by removing removable first portion 8 marked 'ROLL 1' on playing region 4 to reveal indicia in the form of a predetermined outcome of a nominally random event. In this embodiment, the nominally random event is the roll of a die and the predetermined outcome is in the form of a number on the die, as shown in FIG. 1B. From start panel 14, player 1 moves the number of spaces indicated by the number on the die and removes removable first portion 16 on which the player lands. As shown in FIG. 1B, the die of 'ROLL 1' shows a three and therefore player 1 moves three spaces to square number three 18.

If indicia in the form of instructions are revealed by the removal of the removable first portion 16, the player follows the instructions. In this embodiment, the game is of the "snakes and ladders" type and therefore the instructions may direct the player forward up a ladder or backwards down a snake. Other instructions may include, for example, instructing the player to 'ROLL AGAIN'. FIG. 1B shows that square number three 18 comprises the instructions 'GO UP AND SCRATCH SQUARE 14'.

Players 1 and 2 compete against each other and each player takes it in turns to remove their respective removable portions to reveal indicia and move the relevant spaces indicated on the die until all dice rolls have been revealed and all instructions followed. When player 1 removes removable first portion 20 and player two removes removable second portion 22, each denoted as their respective 'FINISH' squares, each player learns whether or not they are the winner. The winner is instructed to remove removable third portion 12 denoted as the 'PRIZE BOX' to see if they have won a prize. In the example shown in FIG. 1B, the winner (player 2) has not won a prize on this occasion. In another example, the player may win, for example, $6, $10, $50 or some other monetary amount or another type of prize, award or reward.

Figure 2A:
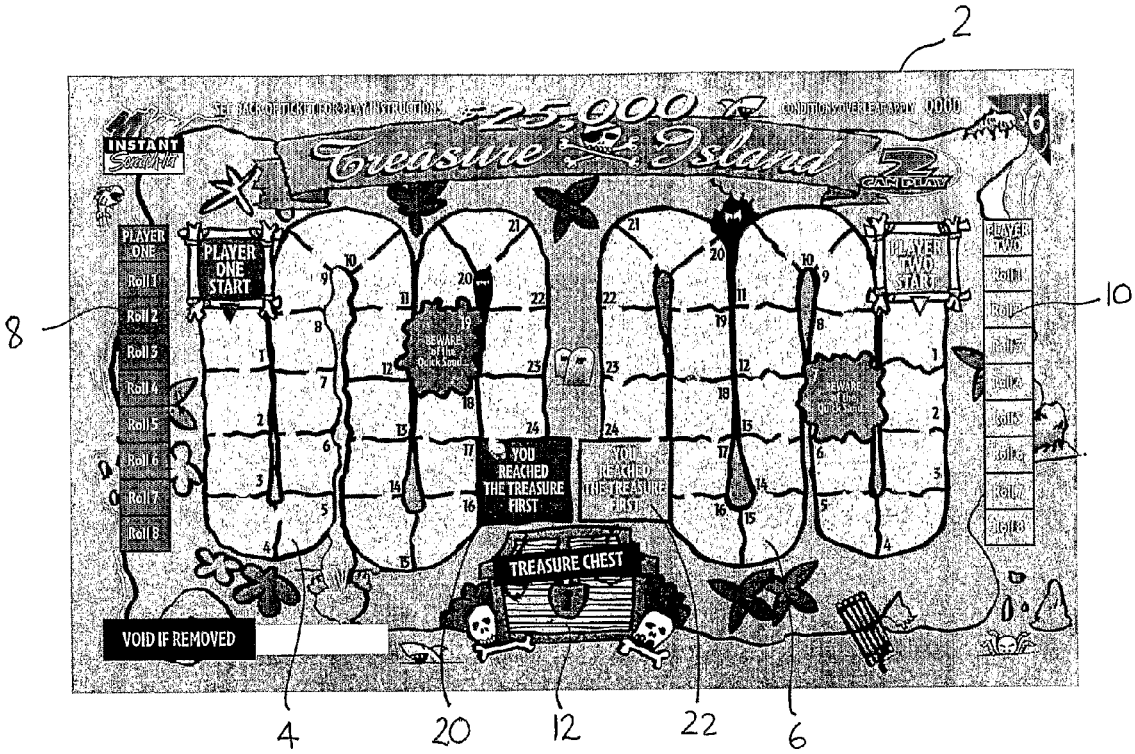
FIG. 2A shows a second embodiment of the gaming ticket before use.
Figure 2B:
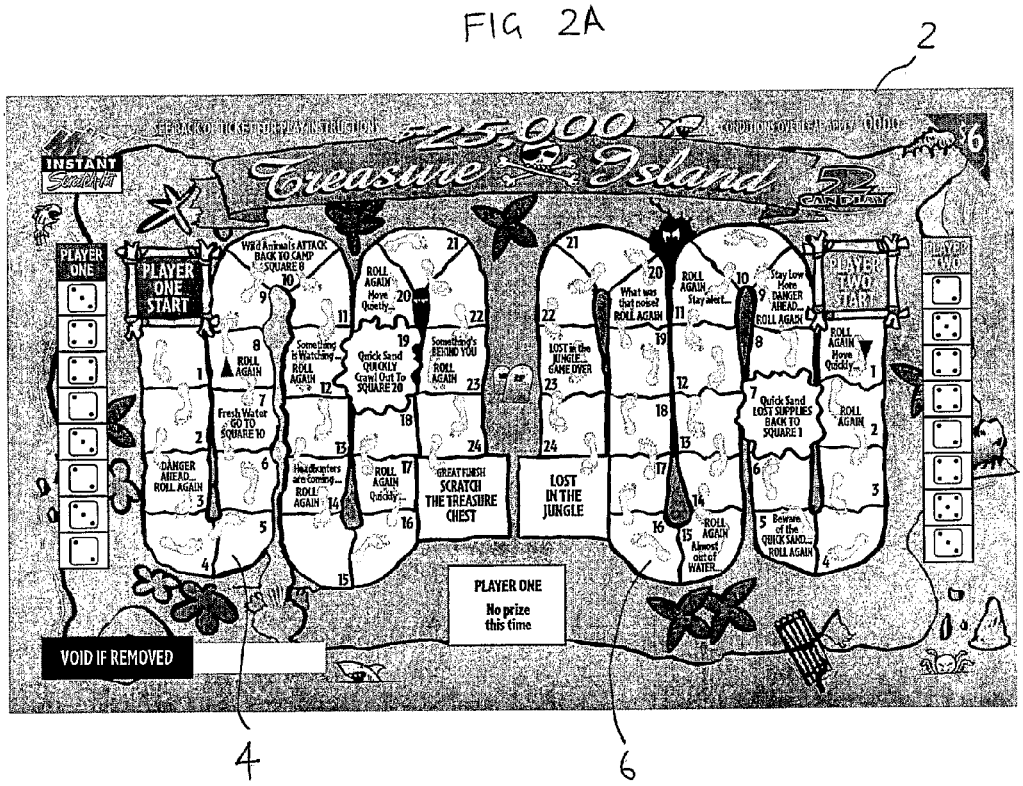
FIG. 2B shows the gaming ticket of FIG. 2A after use.

FIGS. 2A and 2B show a second embodiment of the game ticket 2 of the game of chance, which comprises a game with a "treasure island" theme. Gaming ticket 2 comprises playing region 4 for the first player and playing region 6 for the second player. In this example, playing regions 4 and 6 represent a path through the jungle and a number of squares representing rolls of a die. Playing region 4 comprises removable first portions 8 removable by the first player and playing region 6 comprises removable second portions 10 removable by the second player. Gaming ticket 2 also comprises removable third portion 12 removable by the winner of the game to reveal whether the winner wins a prize.

Player 1 starts the game by removing removable first portion 8 marked 'ROLL 1' to reveal indicia in the form of a predetermined outcome of a nominally random event. In this embodiment, the nominally random event is the roll of a die and the predetermined outcome is in the form of a number on the die, as shown in FIG. 2B. From start panel 16, player 1 moves three spaces as instructed by the number on the die. A removable first portion 8 on the square reached is removed by player 1 and if any indicia in the form of instructions are revealed, the instructions are followed by player 1. In this example, such instructions may include GO FORWARD or GO BACK a number of spaces, ROLL AGAIN, possibly due to specified circumstances such as fresh water or quick sand or the like, or GAME OVER, according to events of a "treasure island" type theme encountered whilst playing the game.

Players 1 and 2 compete against each other and each player takes it in turns to remove their respective removable portions for each 'ROLL' and move the relevant spaces until all dice rolls have been revealed and all instructions followed. When player 1 removes removable first portion 20 and player two removes removable second portion 22, each denoted as their respective 'YOU REACHED THE TREASURE FIRST' squares, each player learns whether or not they are the winner, as shown in FIG. 2B. The winner of the game is instructed to remove removable third portion 12 denoted as the 'TREASURE CHEST' to see if they have won a prize. In the example shown in FIG. 2B, the winner has not won a prize on this occasion. In another example, the player may win, for example, $6, $10, $50 or some other monetary amount or another type of prize, award or reward.

Figure 3B:
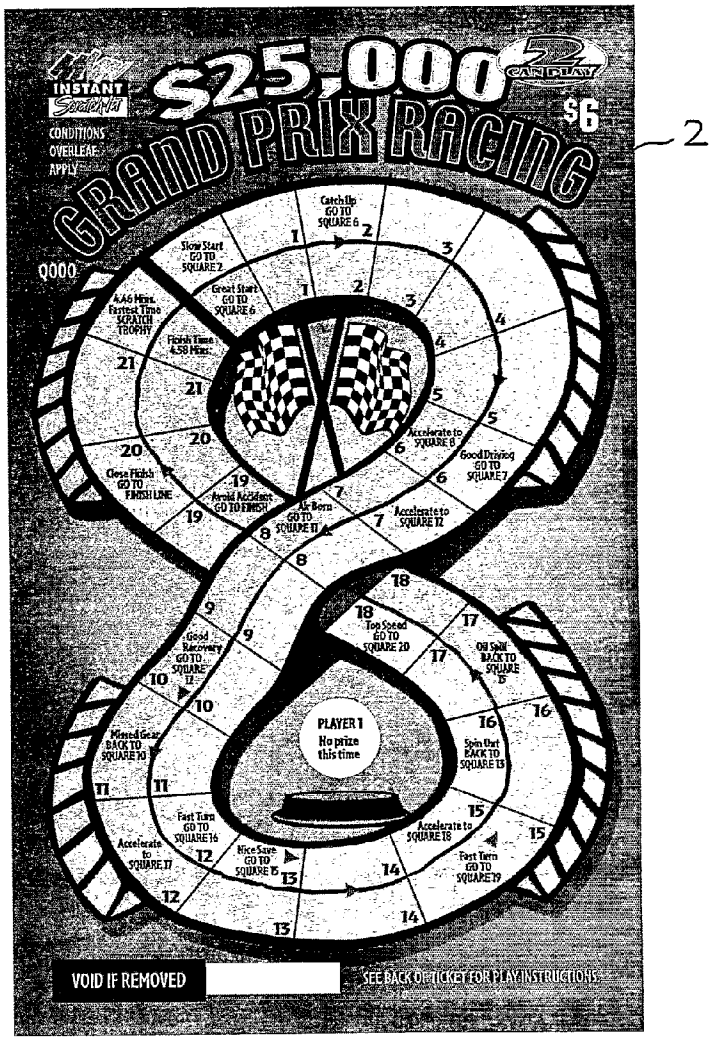
FIG. 3B shows the gaming ticket of FIG. 3A after use.
Figure 3A:
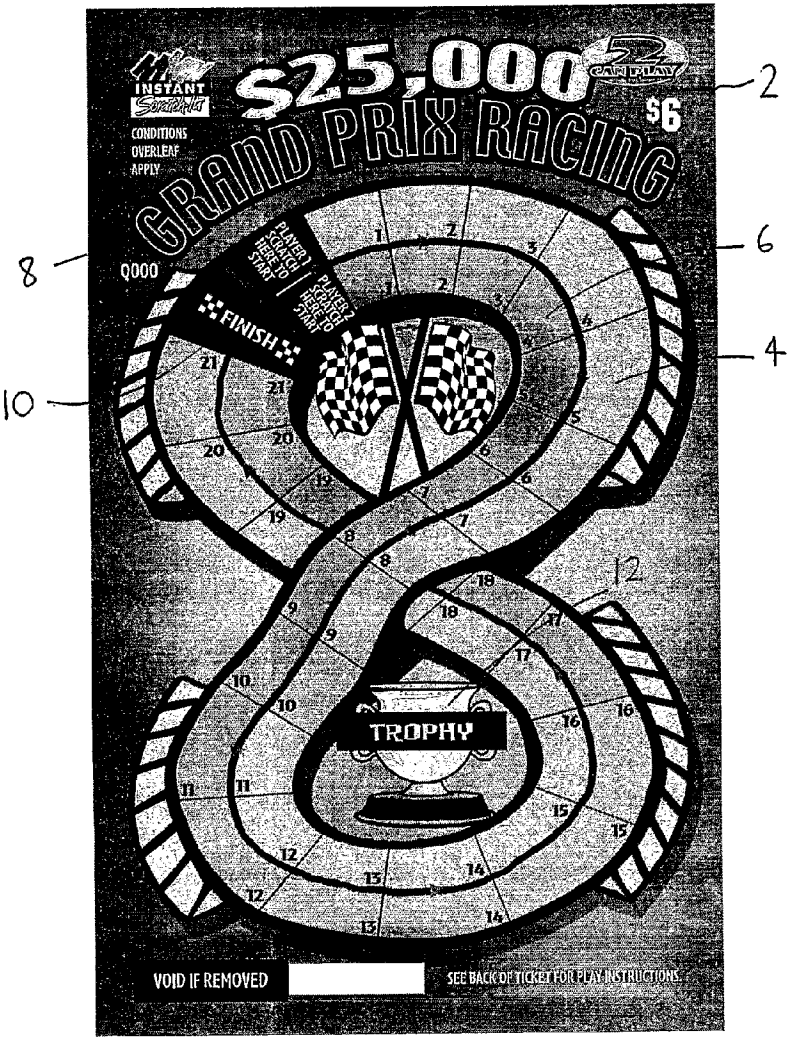
FIG. 3A shows a third embodiment of the gaming ticket before use.
Figure 4B:
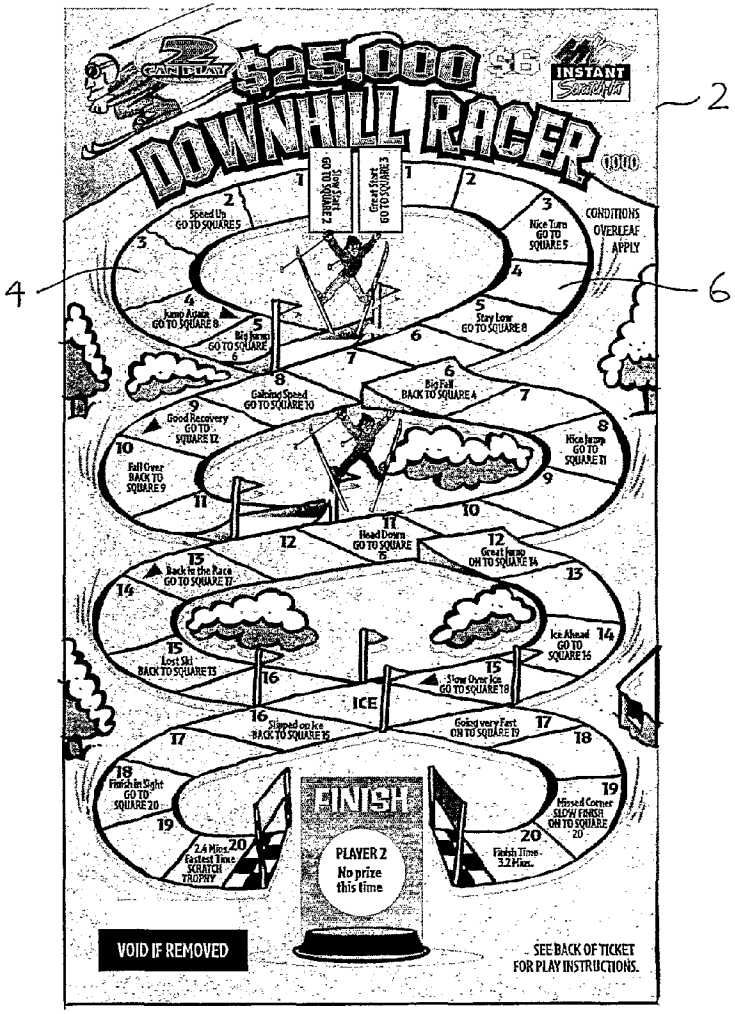
FIG. 4B shows the gaming ticket of FIG. 4A after use.
Figure 4A:
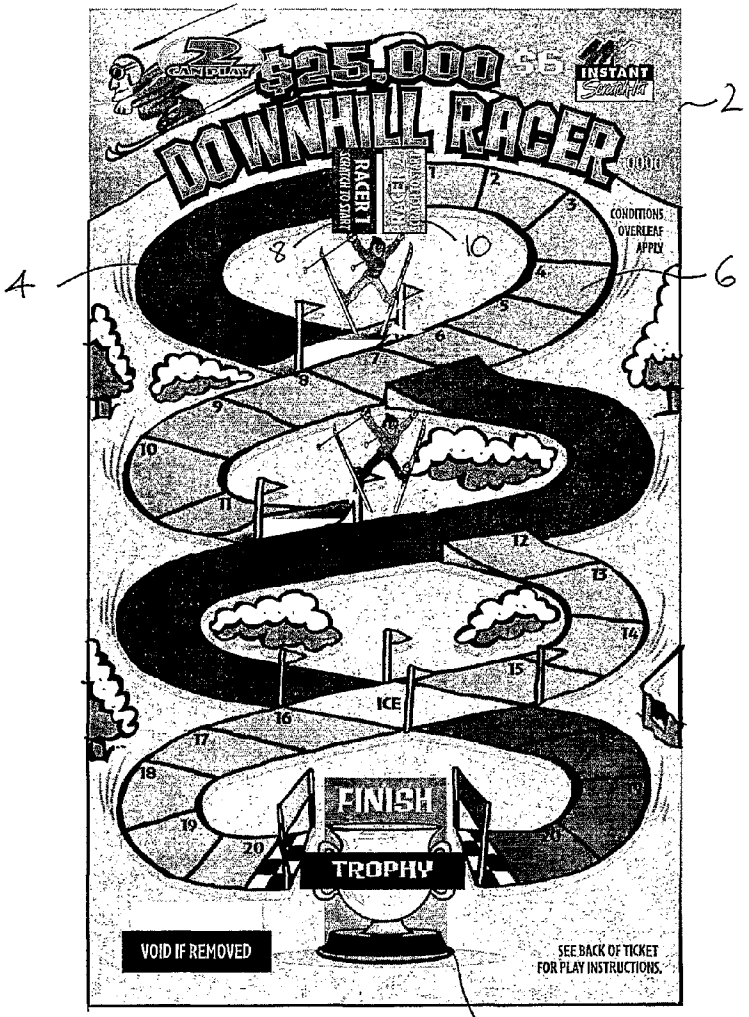
FIG. 4A shows a fourth embodiment of the gaming ticket before use.

FIGS. 3A, 3B, 4A and 4B show third and fourth embodiments respectively of the game ticket 2 of the game of chance and both embodiments show a racing type game. In FIGS. 3A and 3B, playing region 4 for a first player (player 1) and playing region 6 for a second player (player 2), represent a racetrack for each player. In FIGS. 4A and 4B playing region 4 for a first player (player 1) and a playing region 6 for a second player (player 2) represent a downhill ski run for each player.

With reference to FIGS. 3A and 3B, player 1 and player 2 remove first and second removable portions 8, 10 respectively representing a start box marked for their respective playing region 4, 6 to reveal indicia in the form of instructions specifying a 'GO TO square number' instruction, as shown in FIG. 3B. Both players follow the instruction revealed in their respective playing region to move to the next square in their race and remove the respective first/second removable portion of that square to reveal the next instruction. The players continue to remove the removable portions and follow instructions until one or other player or both players reach the finish line. A BACK TO instruction may be revealed and in this case the player must go back to the relevant square indicated and remove the removable portion for that square for their next instruction.

Upon removal of the removable portion covering the final square (the squares marked as FINISH in FIGS. 3A and 3B and squares numbered 20 in FIGS. 4A and 4B), indicia in the form of a race time is revealed. The fastest race time is the winner. In FIGS. 3B and 4B, the fastest time is stated in the relevant square. However, whether the indicated time is the fastest may be omitted from the final square so that a player must wait for the other player to finish before learning whether they are the winner. The player that reveals the fastest time is instructed to remove third removable portion 12 denoted as the 'TROPHY' to see if they have won a prize. FIG. 3B shows that the player has not won a prize this time. In another example, the player may win, for example, $6, $10, $50 or some other monetary amount or another type of prize, award or reward.

Figure 5B:
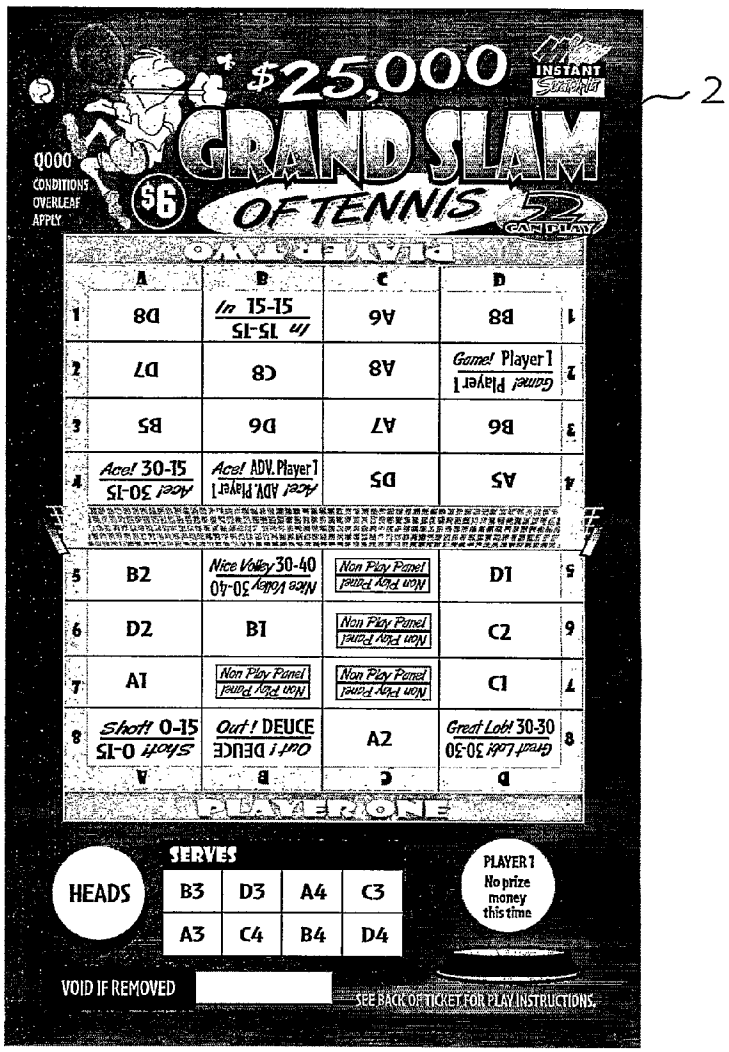
FIG. 5B shows the gaming ticket of FIG. 5A after use.
Figure 5A:
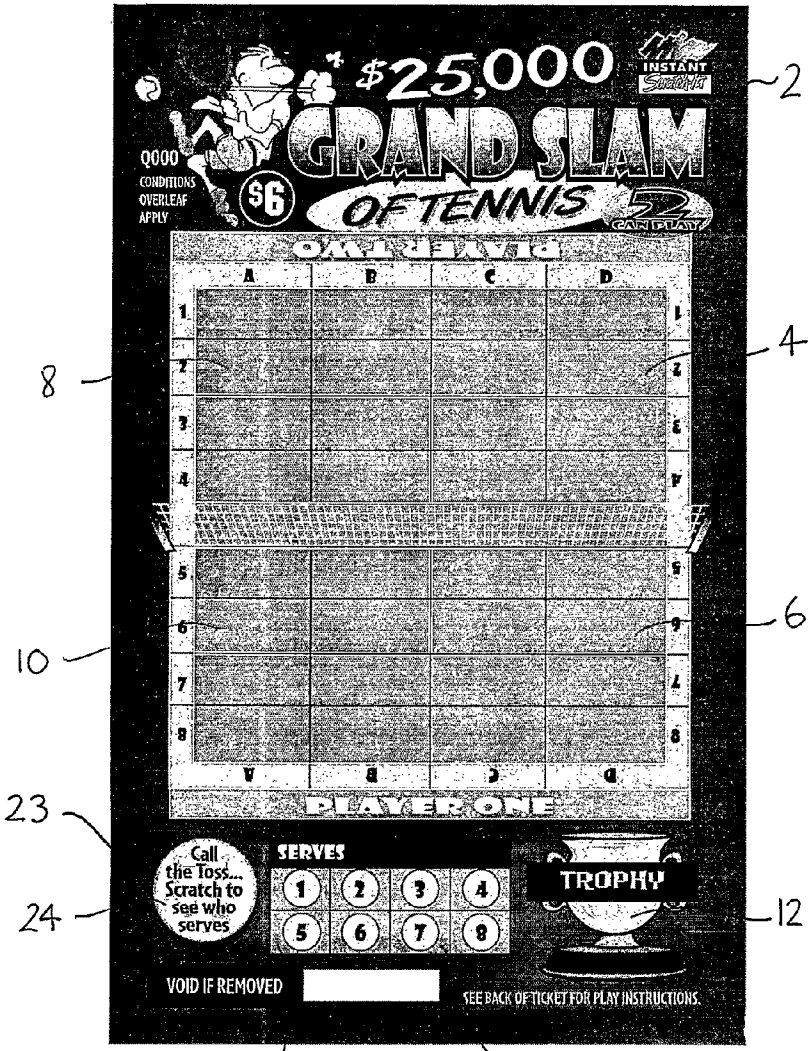
FIG. 5A shows a fifth embodiment of the gaming ticket before use.

Referring to FIGS. 5A and 5B, a fifth embodiment of gaming ticket 2 of the game of chance is in the form of a tennis game to be contested between two or more players and comprises a playing region 4 for a first player (player 1) and a playing region 6 for a second player (player 2). Playing region 4 comprises removable first portions 8 removable by the first player and playing region 6 comprises removable second portions 10 removable by the second player. Gaming ticket 2 also comprises a removable third portion 12 removable by a winner of the game to reveal whether the winner wins a prize. Playing regions 4 and 6 represent halves of a tennis court. Another playing region 23 of the game ticket 2 comprises a removable fourth portion 24 that, once removed, reveals indicia in the form of the predetermined outcome of a nominally random event, such as in this example, a coin toss. In this embodiment, the predetermined outcome determines which player takes a first turn, thus determining which player serves in the game of tennis. In this embodiment, a further playing region 25 comprises a plurality of removable fifth portions 26 representing serves in the tennis match.

One player calls the toss (heads or tails) and removable fourth portion 24 is removed to reveal the predetermined outcome as shown in FIG. 5B. In this example, the indicium is 'HEADS'. The winner of the toss becomes player 1 and 'serves'. The other player becomes player 2. To serve, player 1 removes one of the removable fifth portions 26 corresponding to serve number 1 to reveal indicia in the form of a court reference, which in this example is a letter/number combination, such as B3. Player 1 then removes a removable first portion 8 corresponding to that court reference, which is in playing region 4 on the player 2 side of the court. This will reveal another court reference, unless it is an Ace. If it is an Ace, the point is won immediately by player 1 and the latest game score is revealed. If a court reference is revealed, player 2 returns the serve by removing a removable second portion 10 corresponding to the court reference in playing region 6 on the player 1 side of the court. In this example, the indicia revealed by player 1 in court reference B3 is D6, which is the court reference of the removable second portion 10 removed by player 2. The indicia revealed in court reference D6 is C2, which is the court reference of the removable first portion 8 removed by player 1 and so on.

The players continue to remove removable portions to reveal court references as instructed until a point is won and indicia in the form of the game score revealed. Once a point is won and the game score is revealed player 1 returns to playing region 25 in the form of the "SERVES" box and removes the removable fifth portion corresponding to the next serve number. Play continues until the game is won and the word "GAME" is revealed in either playing region 4 or 6. The player that wins the tennis game removes the removable third portion 12 corresponding to the 'TROPHY' to verify whether they have won a prize. In the example shown in FIG. 5B, the winner has not won any prize money on this occasion. However, in another example, the player may win, for example, $6, $10, $50 or some other monetary amount or another type of prize, award or reward.

Figure 6A:
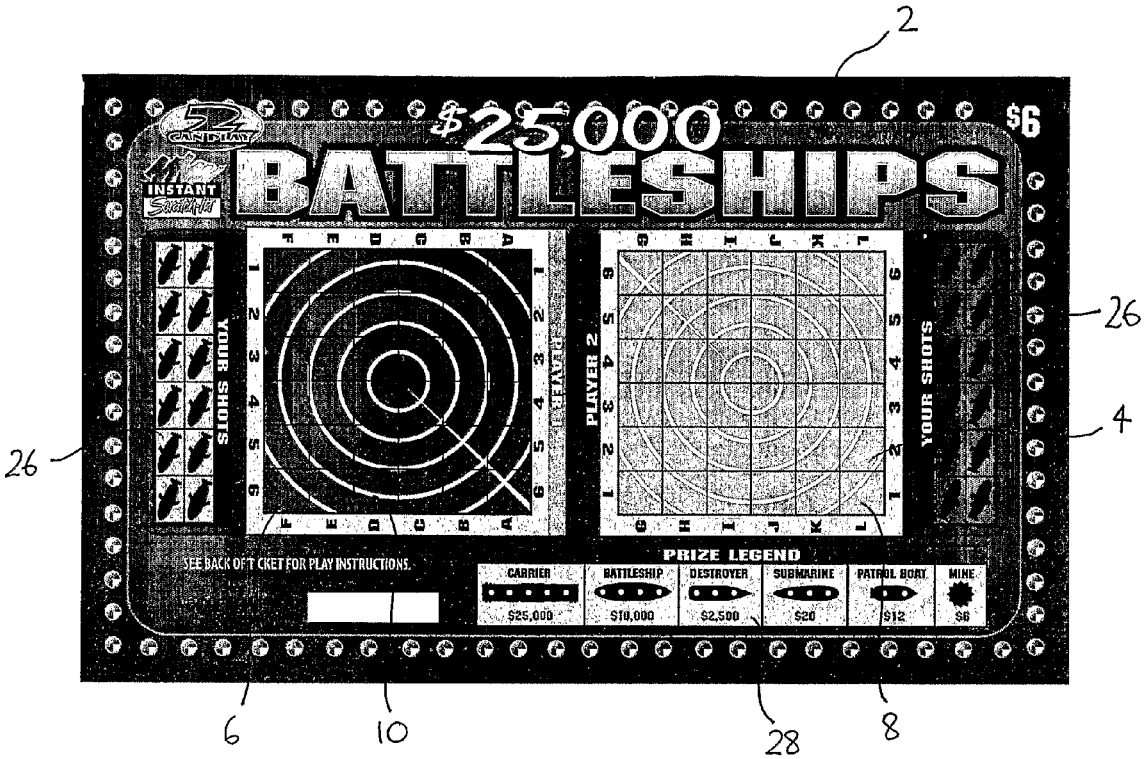
FIG. 6A shows a sixth embodiment of the gaming ticket before use.
Figure 6B:
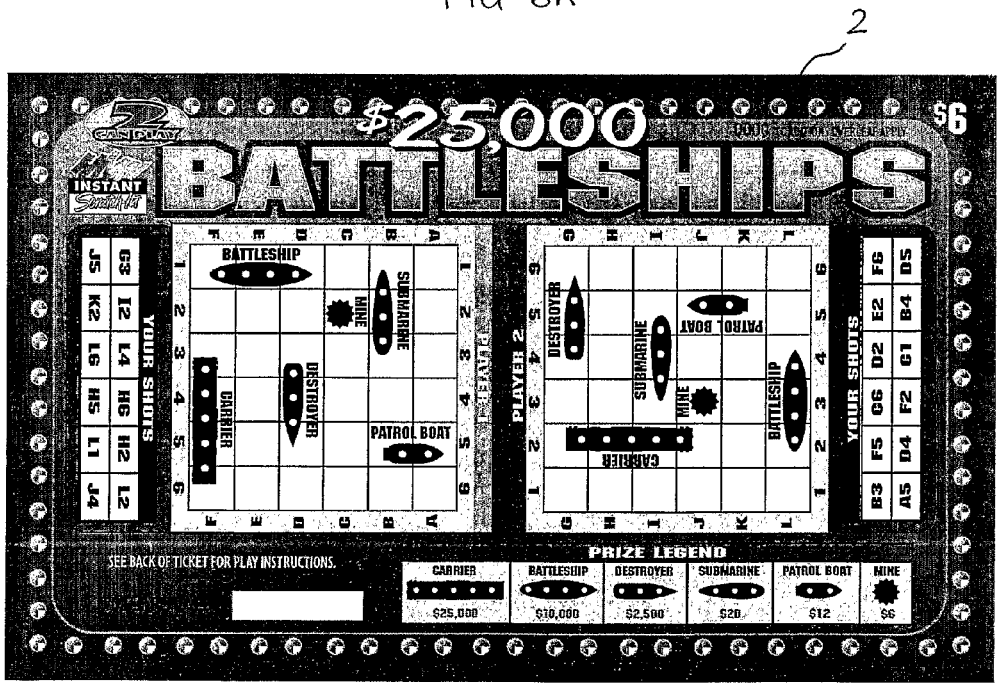
FIG. 6B the gaming ticket of FIG. 6A after use.

Referring to FIGS. 6A and 6B, a sixth embodiment of gaming ticket 2 of the game of chance is in the form of a "battleship" type game to be contested between two or more players and comprises a playing region 4 for a first player (player 1) and a playing region 6 for a second player (player 2). Playing region 4 comprises at least one removable first portion 8 removable by the first player and playing region 6 comprises at least one removable second portion 10 removable by the second player. Playing regions 4 and 6 represent an area of water in which vessels such as a destroyer, a battleship, a patrol boat, an aircraft carrier, a submarine and other nautical objects, such as mines, are located. Playing regions 4 and 6 of the gaming ticket 2 also comprise a plurality of removable fifth portions 26 representing shots that each player may take at their opponent's vessels/nautical objects.

Player 1 and player 2 take it in turns to remove a single removable fifth portion 26 to reveal indicia in the form of grid locations, which in this example are a letter/number combination. Each player then locates the corresponding grid location in their opponent's grid and removes the removable first/second portion 8, 10 from that grid location. The players take turns until all shots for both players have been taken by revealing grid locations and the corresponding removable first/second portions 8, 10 on opponents' grids have been removed. If a player completely uncovers any of their opponent's vessels or a mine, this represents the sinking or exploding of the vessel or mine and the player wins the prize corresponding to the sunken vessel or exploded mine shown in the prize legend 28. The entire vessel must be uncovered to win the corresponding prize shown in the prize legend 28. With reference to FIG. 6B, neither player has won a prize on this occasion. However, in another example, either player may win one of the monetary amounts shown in the prize legend 28 or another type of prize, award or reward.

Whilst most of the aforementioned examples require the player to remove a removable third portion 12 to learn whether the winner of the game of chance has won a prize, removal of the removable first or second portions 8, 10 may inform the winner whether they have won a prize. In an alternative embodiment, as shown in the battleships example, the winner may be informed of whether they have won a prize by the combination of the type of indicia revealed by removing the removable first and second portions 8, 10 and the prize legend 28.

FIGS. 1B, 2B, 3B, 4B, 5B and 6B show the gaming tickets 2 after use with all of the removable portions removed and all indicia shown for the sake of clarity. However, it will be appreciated that once a game has been won by one of the players and the winner of the game has discovered whether they have won a prize, some of the removable portions may remain on the gaming ticket 2, i.e. it is not necessary that all removable portions are removed to reveal all indicia to complete the game of chance.

Figure 7:
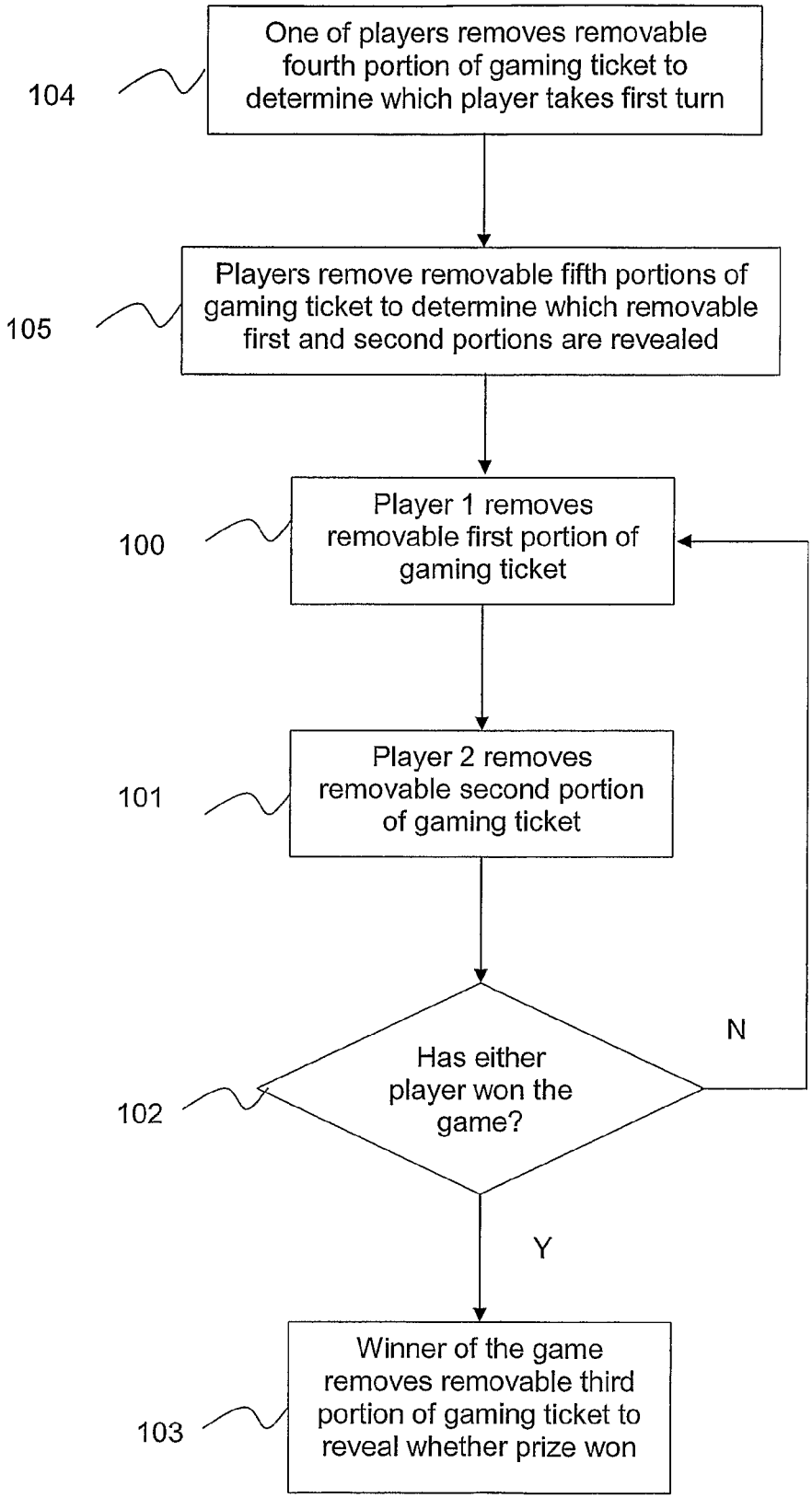
FIG. 7 shows a flow chart of an embodiment of the method of the present invention.

The method of playing a game of chance playable by two or more players in accordance with an embodiment of the present invention is described with reference to the flowchart in FIG. 7. In step 100, a first player removes a removable first portion 8 of the gaming ticket 2. In step 101, a second player removes a removable second portion 10 of the gaming ticket 2. The first and second players compete against each other by the first player repeating step 100 and the second player repeating step 101 until a winner of said game is determined, as represented with the aid of step 102. In step 103, the winner of the game removes a removable third portion of the gaming ticket to reveal whether the winner of the game wins a prize.

Optionally, as represented by step 104, one of the players may remove a removable fourth portion 24 to reveal a predetermined outcome of a nominally random event such as a coin toss or a throw of a die to determine which player takes a first turn.

Optionally, as represented by step 105, players may remove removable fifth portions of the gaming ticket 2 to determine the location of the removable first and second portions 8, 10 that are revealed by the first and second players respectively.

Figure 8A:
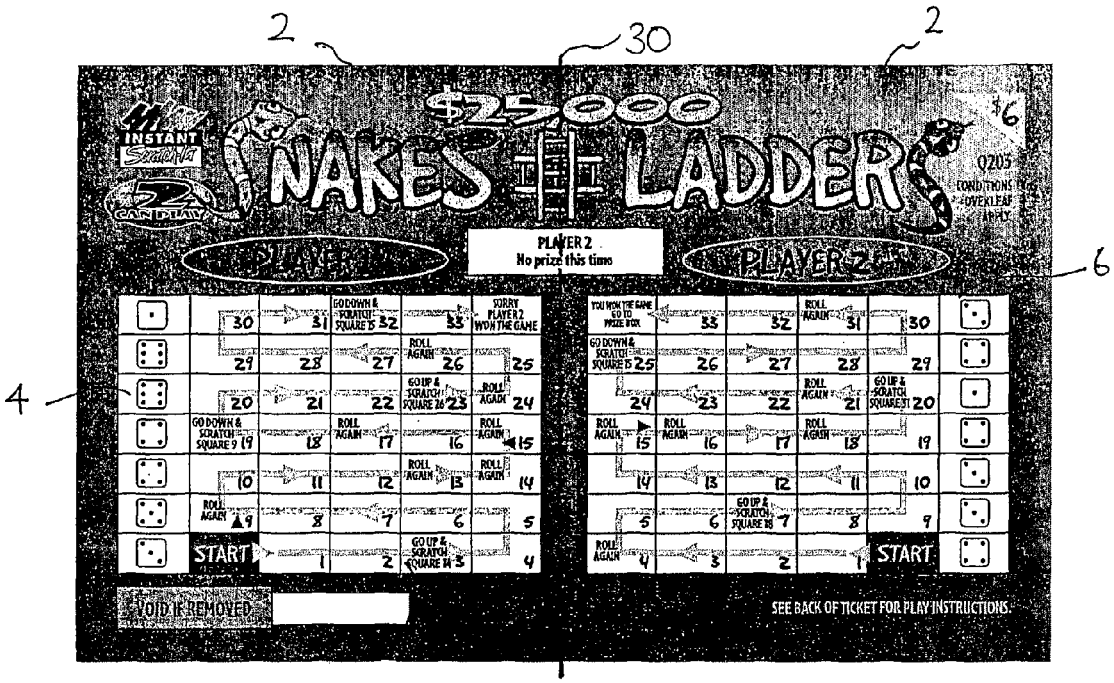
FIG. 8A shows a seventh embodiment of the gaming ticket after use.
Figure 8B:
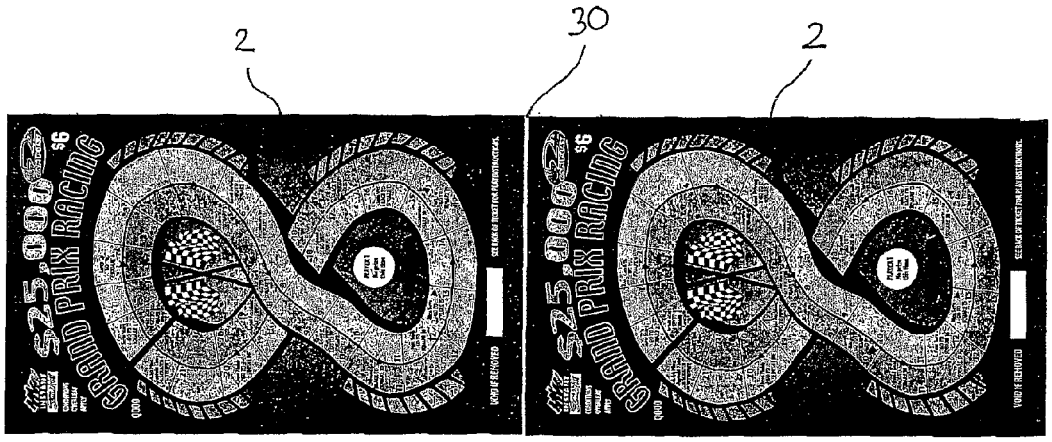
FIG. 8B shows an eighth embodiment of the gaming ticket after use.

With reference to FIGS. 8A and 8B, in one embodiment the game of chance comprises at least two adjoined gaming tickets 2. This may be formed from a length of suitable material, such as card, with a perforation or line of weakness 30 between the adjoined gaming tickets 2. The game of chance on each of the adjoined tickets 2 are related and, according to one embodiment, once the two tickets 2 are separated, the players compete against each other in one of the aforementioned games of chance, but each player plays on their own ticket. For example, in the 'snakes and ladders' game shown in FIG. 8A, playing region 4 comprising removable first portions 8 is printed on one ticket and playing region 6 comprising removable second portions 10 is printed on the adjoined ticket. A similar arrangement could be used for the treasure island, tennis and battleships games. In another embodiment, for example with the racing games, such as 'downhill racer' and 'grand prix racing', playing region 4 comprising one part of the circuit is printed on one ticket and playing region 6 comprising the other part of the circuit is printed on the other ticket. In another embodiment, the at least two adjoined gaming tickets are identical, as shown in FIG. 8B. The barcodes for each of the at least two adjoined tickets 2 will show a correlation demonstrating that the adjoined tickets form part of a whole for accounting and security purposes.

Although the embodiments of the present invention have generally been described with reference to two players competing against each other, it will be appreciated that the present invention can accommodate more than two players. This may be achieved by, for example, including extra tracks/courses in the racing type games such as the "grand prix" type and "downhill racer" type games. The tennis game may, for example, accommodate a doubles match (four players) and the "treasure island" type and "snakes and ladders" type examples could easily be played by teams of players.

In summary, the game of chance may be viewed as a gaming ticket comprising two or more sets of indicia that are initially covered by removable portions of the gaming ticket prior to commencing the game. Two or more players compete against each other by sequentially removing their respective removable portions to reveal one or more indicia of their respective set until a winner of the game is determined. The indicia may comprise instructions for the players for moving through the sets of indicia.

The game of chance and the method of playing the game of chance of the present invention thus provide a game of chance with increased playability compared with conventional games of chance by enabling two or more players to compete against each other by removing the removable portions to reveal indicia to determine who is the winner of the game in addition to revealing whether a prize has been won by the winner of the game.

Throughout the specification the aim has been to describe the invention without limiting the invention to any one embodiment or specific collection of features. Persons skilled in the relevant art may realize further variations from the specific embodiments that will nonetheless fall within the scope of the invention. For example, other games, races, competitions and/or contests may be represented on the game ticket.

The invention claimed is:

1. A game of chance played by two or more players, said game of chance comprising:

a gaming ticket including removable first portions removable by a first player to reveal first indicia and removable second portions removable by a second player to reveal second indicia;

the gaming ticket further comprising a removable third portion removable by a winner of the game of chance to reveal whether the winner wins a prize;

wherein one of the first or second indicia indicates that the first or second player has won the game and instructs the winning player to remove the removable third portion to reveal whether the winning player has won a prize; and wherein said first and second players compete against each other by removing said respective removable first and second portions to reveal further first and second indicia until a winner of said game is determined.

2. The game of chance of claim 1, wherein removal of at least one of the first and second portions reveals indicia in the form of instructions for said players to follow in playing the game.

3. The game of chance of claim 2, wherein said instructions are in the form of a predetermined outcome of a nominally random event.

4. The game of chance of claim 3, wherein the predetermined outcome of the nominally random event determines which player takes a first turn.

5. The game of chance of claim 3, wherein the predetermined outcome of the nominally random event determines the number of first or second portions removed by the first or second player respectively.

6. The game of chance of claim 3, wherein the predetermined outcome of the nominally random event determines the next first or second portion removed by the first or second player respectively.

7. The game of chance of claim 3, wherein the nominally random event is one of the following: a coin toss, a throw of a die or dice.

8. The game of chance of claim 1, further comprising a removable fourth portion wherein removal of said fourth portion reveals indicia in the form of a predetermined outcome of a nominally random event.

9. The game of chance of claim 8, wherein the predetermined outcome of the nominally random event determines which player takes a first turn.

10. The game of chance of claim 8, wherein the nominally random event is one of the following: a coin toss, a throw of a die or dice.

11. The game of chance of claim 1, further comprising a removable fifth portion wherein removal of said fifth portion reveals indicia in the form of instructions which determine the next removable first or second portion removed by the first or second player respectively.

12. The game of chance of claim 1, comprising at least two adjoined gaming tickets.

13. The game of chance of claim 12, wherein a first gaming ticket of said at least two adjoined gaming tickets comprises the removable first portions and a second gaming ticket of said at least two adjoined gaming tickets comprises the removable second portions.

14. The game of chance of claim 12, wherein said at least two adjoined gaming tickets are identical.

15. A method of playing a game of chance played by two or more players, said method including the steps of:

a) providing a gaming ticket including removable first portions and removable second portions;

b) a first player removing the removable first portions of the gaming ticket to reveal first indicia;

c) a second player removing a removable second portion of said gaming ticket to reveal second indicia;

d) said first and second players competing against each other by said first player repeating step b) and said second player repeating step c) to reveal further first and second indicia until one of the first or second indicia indicates that the first or the second player has won the game.

16. The method of claim 15, further including the step of the winner of the game of chance removing a removable third portion of the gaming ticket to reveal whether the winner wins a prize.

17. The method of claim 15, wherein steps b) and c) further include the first and second players following instructions for playing the game revealed by the removal of said first and second portions.

18. The method of claim 17, wherein said instructions are in the form of a predetermined outcome of a nominally random event.

19. The method of claim 18, further including the step of the predetermined outcome of the nominally random event determining which player takes a first turn.

20. The method of claim 18, further including the step of the predetermined outcome of the nominally random event determining the number of first or second portions removed by the first or second player respectively.

21. The method of claim 18, further including the step of the predetermined outcome of the nominally random event determining the next first or second portion removed by the first or second player respectively.

22. The method of claim 18, wherein the nominally random event is one of the following: a coin toss, a throw of a die or dice.

23. The method of claim 15, further including the step of one of the players removing a removable fourth portion to reveal a predetermined outcome of a nominally random event.

24. The method of claim 23, further including the step of the predetermined outcome of the nominally random event determining which player takes a first turn.

25. The method of claim 23, wherein the nominally random event is one of the following: a coin toss, a throw of a die or dice.

26. The method of claim 15, further including the step of one of the players removing a removable fifth portion to reveal indicia in the form of instructions for determining the next removable first or second portion removed by the first or second player respectively.

27. A game of chance played by two or more players, said game of chance comprising:

a gaming ticket including a first set of indicia revealable by a first player and a second set of indicia revealable by a second player;

the gaming ticket further comprising a third indicium revealable by a winner of the game of chance to reveal whether the winner wins a prize;

wherein one of the first set of indicia or second set of indicia indicates that the first or second player has won the game and instructs the winning player to reveal the third indicium to reveal whether the winning player has won a prize; and wherein said first and second players compete against each other by sequentially revealing said respective first and second indicia in accordance with associated instructions until the winner of said game is determined.

* * * * *